US007391291B2

(12) United States Patent
Miyata

(10) Patent No.: US 7,391,291 B2
(45) Date of Patent: Jun. 24, 2008

(54) SEALED RARE EARTH MAGNET AND METHOD FOR MANUFACTURING THE SAME

(75) Inventor: Koji Miyata, Takefu (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

(21) Appl. No.: 11/063,008

(22) Filed: Feb. 22, 2005

(65) Prior Publication Data

US 2005/0190031 A1 Sep. 1, 2005

(30) Foreign Application Priority Data

Feb. 26, 2004 (JP) ..... 2004-050980

(51) Int. Cl.
*H01F 7/02* (2006.01)

(52) U.S. Cl. ..... 335/302

(58) Field of Classification Search ..... 335/296–306; 29/607–609

See application file for complete search history.

(56) References Cited

U.S. PATENT DOCUMENTS

| | | | | |
|---|---|---|---|---|
| 4,647,891 | A * | 3/1987 | Hughes | 335/302 |
| 4,769,624 | A * | 9/1988 | Merritt et al. | 335/302 |
| 4,810,987 | A * | 3/1989 | Liebthal et al. | 335/302 |
| 4,948,475 | A * | 8/1990 | Doetzer et al. | 205/234 |
| 5,337,033 | A * | 8/1994 | Kinouchi et al. | 355/302 |
| 5,569,335 | A * | 10/1996 | Takahashi | 148/302 |
| 5,658,396 | A | 8/1997 | Sakurada et al. | |
| 5,750,044 | A | 5/1998 | Yoneyama et al. | |
| 6,290,782 | B1 | 9/2001 | Sakurada et al. | |
| 6,299,450 | B1 * | 10/2001 | Honkura et al. | 433/189 |
| 6,499,220 | B2 * | 12/2002 | Katsuki et al. | 33/391 |
| 2002/0011279 | A1 | 1/2002 | Sakurada et al. | |
| 2004/0140253 | A1 * | 7/2004 | Wang | 210/222 |

FOREIGN PATENT DOCUMENTS

| | | | |
|---|---|---|---|
| EP | 1 383 143 | | 1/2004 |
| JP | 01170808 | A * | 7/1989 |
| JP | 03173105 | A * | 7/1991 |
| JP | 05029116 | A * | 2/1993 |
| JP | 5-143972 | | 6/1993 |
| JP | 10277545 | A * | 10/1998 |
| JP | 11-087119 | | 3/1999 |

OTHER PUBLICATIONS

European Search Report for 05251040.1 dated Jul. 15, 2005.

(Continued)

*Primary Examiner*—Ramon M Barrera
(74) *Attorney, Agent, or Firm*—Alston & Bird LLP

(57) ABSTRACT

It is an object of the present invention to provide a rare earth magnet that will not decompose due to hydrogen embrittlement when used in a hydrogen gas atmosphere, and furthermore, does not pose the risk of contaminating a reaction bath with the surface treated film of the magnet. The present invention provides a sealed rare earth magnet comprising: a rare earth magnet; and a case of aluminum or aluminum alloy, wherein the case covers entirety of the rare earth magnet and is sealed by HIP; and the methods for manufacturing the same.

10 Claims, 3 Drawing Sheets

OTHER PUBLICATIONS

Lectard et al., "Saturation Magnetization and Anistropy Fields in the $SM(Co_{1-x}Cu_x)_5$ Phases, " *J. Applied Physics*, vol. 75, No. 10, pp. 6277-6279, May 15, 1994.

Xiong et al., "Study on the Microstructure and Magnetic Properties of Rapidly Quenched $SM(Co_{1-x}Cu_x)_5$ Alloys," *Proc. 17th Int. Workshop on RE Magnets and Their Applications*, pp. 893-899, Aug. 2002.

Trammell, "Magnetic Ordering Properties of Rare-Earth Ions in Strong Cubic Crystal Fields," *Physical Review*, vol. 131, No. 3, pp. 932-948; Aug. 1, 1963.

Halbach, "Design of Permanent Multipole Magnets With Oriented Rara Earth Cobalt Material," *Nuclear Instruments and Methods*, vol. 169, pp. 1-10, 1980.

* cited by examiner

SEALED RARE EARTH MAGNET AND METHOD FOR MANUFACTURING THE SAME

BACKGROUND OF THE INVENTION

1. Field of the Inention

The present invention relates to sealed rare earth magnets and methods for manufacturing the same, and more specifically relates to sealed rare earth magnets used in motors or semiconductor manufacturing devices, and methods for manufacturing the same.

2. Description of Related Art

Rare earth magnets have utilized in various fields such as motors and semiconductor manufacturing devices. For example, when rare earth magnets are utilized in motors for fuel cell vehicles, there is a risk that the rare earth magnets will be exposed to a hydrogen gas atmosphere. In addition, etchers and the like in semiconductor manufacturing devices sometimes utilize hydrogen gas as the reacting gas. In such a case, there is a possibility that when rare earth magnets are used in semiconductor manufacturing devices, there is a risk that they will be similarly exposed to the hydrogen gas atmosphere. Rare earth magnets suffer from hydrogen embrittlement. Therefore, even if various anti-oxidation surface treatment methods such as nickel plating, copper plating, aluminum ion plating and resin coating are utilized on the magnet surface, when in a hydrogen atmosphere, there is the problem of the risk that the magnet will be destroyed due to hydrogen embrittlement. As a rare earth magnet in which countermeasures are taken against hydrogen embrittlement, Japanese Patent Application Unexamined Publication No. H11-087119/1999 A, which is herein incorporated by reference, discloses a rare earth magnet that has a hydrogen storage alloy, which shows a plateau pressure of 0.001 to 0.1 MPa at a temperature of 400 K and above, as a surface treatment film, wherein the rare earth magnet is preferably $Nd_2Fe_{14}B_1$, and wherein the surface treatment film is preferably made by providing a Pd plating on the surface of the $Nd_2Fe_{14}B_1$.

SUMMARY OF THE INVENTION

It was found that a permanent magnet provided with the above-noted surface treatment shows no abnormalities in 100 ppm hydrogen gas. However, in a hydrogen gas atmosphere at a higher pressure, there is the problem that the magnet material was reduced to a particulate state by hydrogen embrittlement. Furthermore, in cases in which the permanent magnet is utilized in semiconductor manufacturing devices, when the surface treated film is nickel or copper, there is the problem of the risk of contaminating the reaction bath.

Thus, it is an object of the present invention to provide a rare earth magnet that will not decompose due to hydrogen embrittlement when used in a hydrogen gas atmosphere, and furthermore, does not pose the risk of contaminating a reaction bath with the surface treated film of the magnet.

In one aspect of the present invention, there is provided a sealed rare earth magnet comprising: a rare earth magnet; and a case of aluminum or aluminum alloy, wherein the case covers entirety of the rare earth magnet and is sealed by HIP.

In another aspect of the present invention, there is provided a sealed rare earth magnet comprising: a rare earth magnet; and a case of aluminum or aluminum alloy, wherein the case covers entirety of the rare earth magnet and has substantially no pinholes.

In another aspect of the present invention, there is provided a method for manufacturing a sealed rare earth magnet, the method comprising the steps of: covering a rare earth magnet or a rare earth magnet material with a case of aluminum or aluminum alloy; and sealing the case by HIP.

As will be described in detail below, with the present invention, by covering a rare earth magnet with an aluminum case and sealing the permanent magnet by HIP processing, it is possible to increase the hydrogen gas resistivity of rare earth magnets within a hydrogen gas atmosphere. Thus, it is possible to widen the range of environments in which the rare earth magnet can be used. Furthermore, even if the rare earth magnet is used in semiconductor manufacturing devices, the surface treatment of the rare earth magnet prevents contamination of the reaction bath.

DEATILED DESCRIPTION OF PREFERRED EMBODIMENTS

Figure 1:
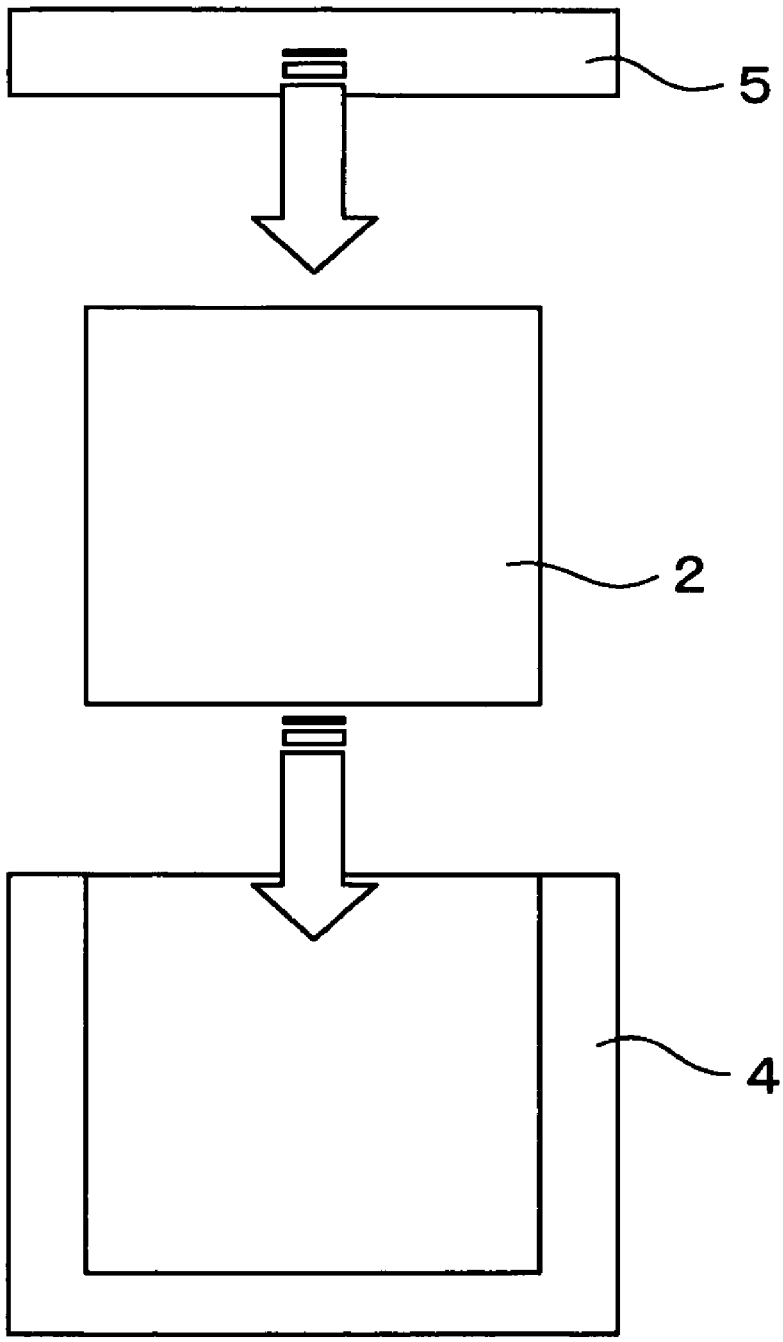
FIG. 1 schematically shows the step of covering the rare earth magnet with an aluminum case in the method for manufacturing the sealed rare earth magnet according to one embodiment of the present invention.

Embodiments of the present invention are described below with reference to the attached drawings. The embodiments described below do not limit the present invention.

As described above, the present invention provides a sealed rare earth magnet comprising a rare earth magnet; and a case of aluminum or aluminum alloy (also referred to below simply as an "aluminum case"), wherein the case covers entirety of the rare earth magnet and is sealed by HIP processing.

Examples of rare earth magnets that may be utilized in the present invention comprise R—Co-based rare earth magnets and R—Fe—B-based rare earth magnets. Here, R represents a rare earth metal, and more specifically comprises the 15 elements having an atomic number from number 57 to number 71 (the lanthanides: lanthanum (La), cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb) and lutetium (Lu)), and number 21 scandium (Sc) and number 29 yttrium (Y). It is particularly preferable that one or more selected from the group consisting of Y, La, Ce, Pr, Nd, Sm, Eu, Gd, Tb, Dy, Ho, Er, Tm, Yb and Lu is used as R.

Here, "R—Co-based rare earth magnets" refer to a material of a composition that contains one or more rare earth elements R and Co, which comprises a composition in which one part of the Co is substituted with Fe. More specifically, R—Co-based rare earth magnets comprise $RCo_5$-based and $R_2Co_{17}$-based ones and the like. However, most of the R—Co-based rare earth magnets in actual use are $R_2Co_{17}$-based ones. $R_2Co_{17}$-based rare earth magnets usually, but not exclusively, comprise 20 to 30% R, 5 to 30% Fe, 3 to 10% Cu and 1 to 5% Zr, with the remaining portion Co based on weight percent. Not exclusively, the $R_2Co_{17}$-based rare earth magnet may be manufactured as follows. First, the raw material metal is weighed, melted, and cast, and obtained alloy is finely crushed to an average particle diameter of 1 to 20 μm to obtain $R_2Co_{17}$-based rare earth permanent magnet powder. The $R_2Co_{17}$-based rare earth permanent magnet powder is molded within a magnetic field, subsequently sintered at 1100 to 1250° C. for 0.5 to 5 hours, then subjected to solution heat treatment for 0.5 to 5 hours at a temperature less than the sintering temperature by 0 to 50° C., and finally subjected to aging treatment. Aging treatment is usually performed in the first step by maintaining the magnet at 700 to 950° C. for a specified time period, followed by continuously cooling or step-wise aging treatment. The $RCO_5$-based magnets usually comprise 30 to 40 wt % R as the principal components with the remaining portion Co based on weight percent.

Furthermore, R—Fe—B-based rare earth magnets have a composition containing one or more rare earth elements R; iron, or iron and Co; boron; and optional additives. R—Fe—B-based rare earth magnets are usually, but not exclusively, comprise 5 to 40% R, 50 to 90% Fe and 0.2 to 8% B based on weight percent. In order to improve the magnetic properties, additive elements such as C, Al, Si, Ti, V, Cr, Mn, Co, Ni, Cu, Zn, Ga, Zr, Nb, Mo, Ag, Sn, Hf, Ta and W are often added to R—Fe—B-based rare earth magnets. It is usual that the amount of these additives is 30 wt % or less in the case of Co, and 8 wt % or less in the case of other elements. The addition of more additives than this may run the risk of conversely degrading the magnetic properties. Not exclusively, R—Fe—B based rare earth magnets may be manufactured as follows. First, the raw material metal is weighed, melted, cast, and obtained alloy is finely crushed to an average particle diameter of 1 to 20 μm to obtain R—Fe—B-based rare earth permanent magnet powder. The R—Fe—B-based rare earth permanent magnet powder is molded within a magnetic field, subsequently sintered at 1100 to 1200° C. for 0.5 to 5 hours, followed by aging treatment at 400 to 1000° C. to obtain the R—Fe—B-based rare earth magnet.

Furthermore, usually, in case of R—Co-based rare earth magnets, magnets having an energy product of 18 to 34 MGOe, and in case of R—Fe—B-based rare earth magnets, magnets having an energy product of 26 to 52 MGOe are used most effectively. The shape of the rare earth magnet is not limited, and, any desired shape can be used, such as cubic, rectangular, columnar, cylindrical and fan-shaped magnets.

The sealed rare earth magnet according to the present invention also comprises a case of aluminum or aluminum alloy wherein the case covers entirety of the rare earth magnet and is sealed by HIP processing. For the case for covering the magnet, pure aluminum or aluminum alloy is used. This is because even if the magnet is utilized in semiconductor manufacturing devices or the like, there is no risk of contaminating the reaction bath of the semiconductor manufacturing device. In other words, this is because the reaction bath of semiconductor manufacturing devices is usually made of aluminum and therefore even if the magnet according to the present invention is contained internally for providing magnetic fields used in the reaction processes and the like, there is no contamination of the reaction bath. In addition, as described in detail below, by using an aluminum case, it is possible to carry out HIP processing at a temperature of about 500° C., and thus it is possible to seal the magnet without affecting the magnetic characteristics of the magnet. Suitable aluminum alloys for the present invention comprise Al—Cu, Al—Mn, Al—Si, Al—Mg, Al—Mg—Si and Al—Zn-based aluminum alloys. Especially, alloys that are easily joined by HIP processing comprise pure aluminum and Al—Mn and Al—Mg—Si-based alloys. More specifically, they comprise materials with the JIS (Japanese Industrial Standards) material numbers A1100, A3003 and A6061.

The shape of the case is not limited, and preferably selected from shapes such as rectangular, cubic, columnar, and cylindrical shapes, depending on the shape of the magnet. It should be noted that cases in which a magnet is covered may comprise a case portion and a lid portion. Furthermore, it is preferable that the shape inside the case is matched to the shape of the magnet. The thickness of the aluminum is not limited, however the greater the thickness, the more able it is to prevent penetration of hydrogen. More specifically, not exclusively, it is preferable that the thickness of the aluminum is 0.5 to 10 mm.

As noted above, the sealed rare earth magnet according to the present invention can be manufactured by the steps of covering a rare earth magnet or a rare earth magnet material with a case of aluminum or aluminum alloy; and sealing the case by HIP processing. FIG. 1 schematically shows the step of covering the rare earth magnet with an aluminum case in the method for manufacturing the sealed rare earth magnet according to one embodiment of the present invention. More specifically, by processing the aluminum material, it is possible to fabricate a case portion and a lid portion in which the magnet is inserted. Subsequently, as shown in FIG. 1, by inserting a rare earth magnet 2 into an aluminum case portion 4 and shutting the open portion of the case portion with a lid portion 5, the rare earth magnet can be covered by the aluminum case. It should be noted that, as is described below, the rare earth magnet can be magnetized before or after the step of covering with the aluminum case. In the latter case, it is possible to cover the rare earth magnet material with the aluminum case. In a similar manner, the rare earth magnet can be magnetized before or after the step of sealing with HIP processing.

In particular, it is an object of the present invention to obtain a magnet in which hydrogen embrittlement does not occur, and furthermore, rare earth permanent magnets are particularly susceptible to degradation by oxidation. Therefore, when the magnet is inserted into the case, it is preferable that the concentration of oxygen in the magnet is 100 to 10,000 ppm and is more preferably 500 to 6,000 ppm. In a similar manner, when the magnet is inserted into the case, it is preferable that the concentration of hydrogen in the magnet is 50 ppm or less, and is more preferably 10 ppm or less.

Figure 2A:
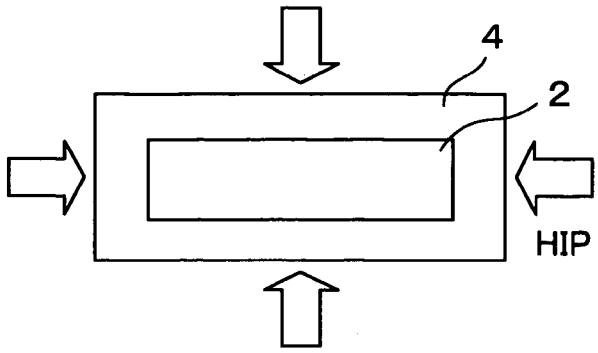
FIG. 2 schematically shows horizontal (A) and vertical (B) cross-sectional views of the step of sealing the aluminum case by HIP processing, in the method for manufacturing the sealed rare earth magnet according to one embodiment of the present invention.
Figure 2B:
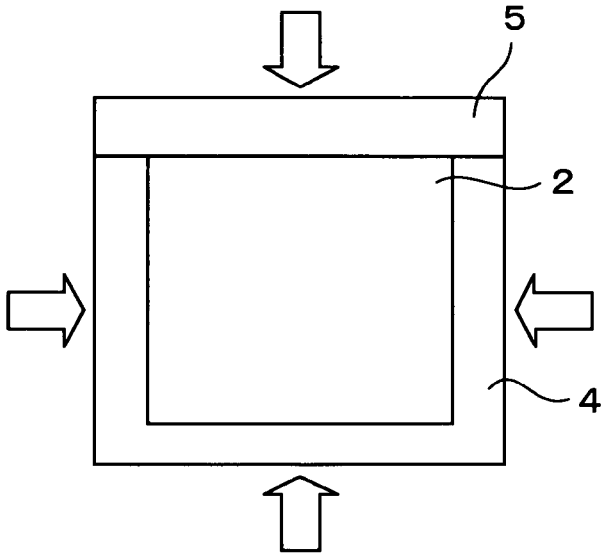

Moreover, the sealed rare earth magnet according to the present invention is sealed by HIP processing. HIP processing is also known as hot isostatic pressing or hot isotropic pressing, and is a technology in which an object to be processed is pressured by applying a high isotropic pressure at high temperature via a pressure medium such as a gas. FIG. 2 schematically shows horizontal (A) and vertical (B) cross-sectional views of the step of sealing the aluminum case by HIP processing, in the method for manufacturing the sealed rare earth magnet according to one embodiment of the present invention. As shown in FIG. 2, for example, when the aluminum case comprises the case portion 4 and the lid portion 5 as described above, by HIP processing these parts it is possible to join the case portion in which the magnet 2 is inserted and the lid portion.

It is preferable that HIP processing is performed under the following conditions. That is to say, it is preferable that the processing temperature is 0.6 or more times the melting point of aluminum or the aluminum alloy (approximately 660° C.), (for example, if the melting point is 600° C., the processing temperature is 396° C. or greater) and less than or equal to the melting point, and more specifically, is preferably 500 to 600° C. Furthermore, for the processing time, the longer the time, the further the joining becomes. More specifically, it is preferable that the processing time is 1 to 3 hours. Furthermore, it is preferable that the processing pressure is 1,000 to 2,000 kg/cm$^2$. Furthermore, it is preferable that the pressure medium for applying isotropic pressure to the object to be processed is a gas such as argon (Ar). This is because under these conditions the magnetic characteristics of the magnetic material are less liable to change.

According to the present invention, by sealing by HIP processing, it is possible to completely seal a separated aluminum case and to prevent penetration of hydrogen without change in the magnetic properties of the magnet material. Specifically, with the present invention, because the permanent magnet is completely sealed by aluminum, there is no contact between the magnet and hydrogen gas. On the other hand, since processes such as CIP (Cold Isostatic Pressing) do not ensure good contact of the separated aluminum case, they cannot prevent the penetration of hydrogen gas.

Furthermore, HIP processing is preferable because pinholes can be prevented. Welding is an example of a method for sealing the case. However, welding is not preferable, since it cannot prevent pinholes, and hydrogen may penetrate through the pinholes. On the other hand, since HIP processing has the effect of pressing out and removing air holes within the material, pinholes are not substantially present in the case of the present invention. It should be noted that the presence or absence of pinholes can be confirmed as follows. That is to say, they can be measured by visual inspection, or by devices such as detection devices that use CCD image analysis or detection devices that use low frequency pulses.

Moreover, as an example of a method for sealing the case, there is a method which uses seal material such as O-rings. However when seal materials are used, there is the problem that the case increases in size by the size of the seal portion.

Figure 3:
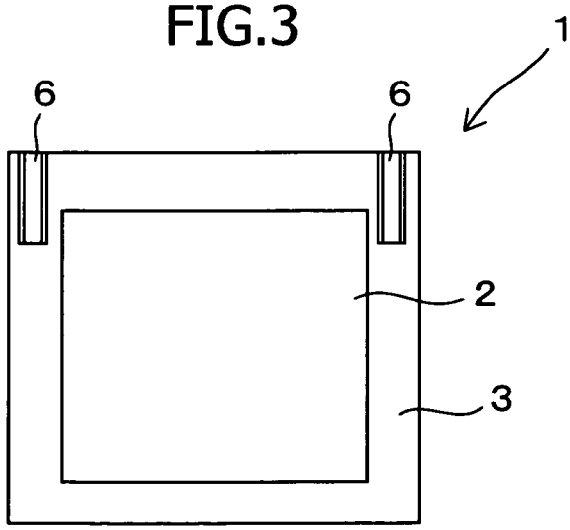
FIG. 3 schematically shows a frontal view of the sealed rare earth magnet according to one embodiment of the present invention.

Moreover, with the present invention, after HIP processing, it is possible to machine the case and its surroundings where necessary. FIG. 3 schematically shows a frontal view of the sealed rare earth magnet according to one embodiment of the present invention. A sealed magnet 1 shown in FIG. 3 is an example in which tap holes 6 have been opened by machining in an aluminum case 3 covering the magnet 2. Since the rare earth magnet is a sintered body, and thus has mechanically fragile characteristics, the magnet can not be tapped. However, with the sealed magnet according to the present invention, since the rare earth magnet is covered by the aluminum case, tap holes can be provided in the aluminum case, and thus it is possible to mechanically fix the rare earth magnet to a device.

Furthermore, with the present invention, after HIP processing, it is also possible to perform alumite treatment or the like. By alumite treatment, it is possible to improve properties such as the corrosion resistance, hardness, abrasion resistance and heat resistance of the sealed rare earth magnet. The conditions for alumite treatment can be arranged by one skilled in the art as appropriate in accordance with the object as exemplified as follows. That is to say it may be processed by degreasing, rinsing, etching, rinsing, neutralizing, electrolyzing (alumite treatment), rinsing, colouring, rinsing, sealing, hot water rinsing and drying.

Figure 4A:
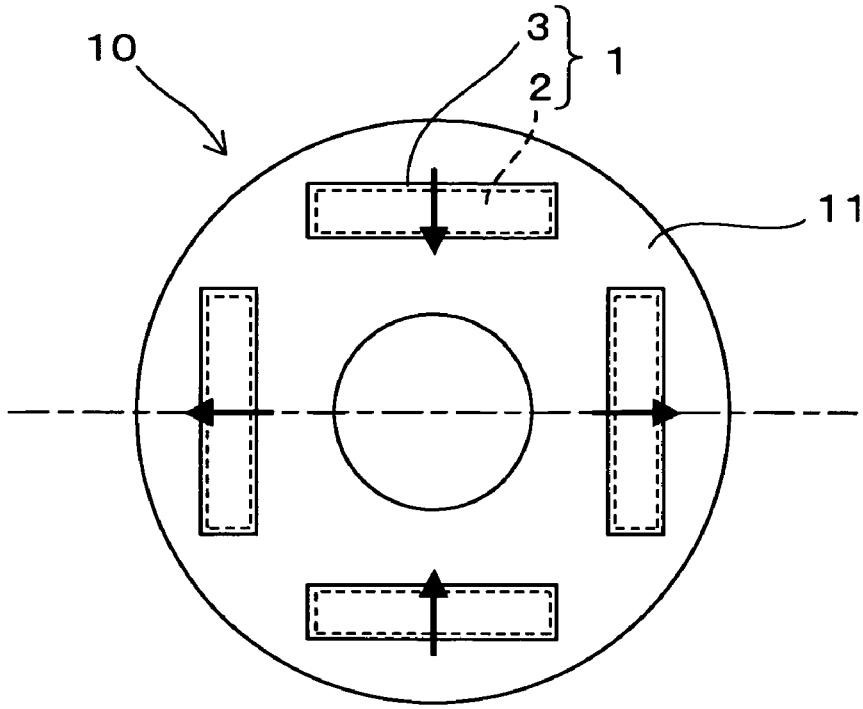
FIG. 4 schematically shows a rotor of a four pole IPM motor, wherein the sealed magnet according to the present invention is utilized.
Figure 4B:
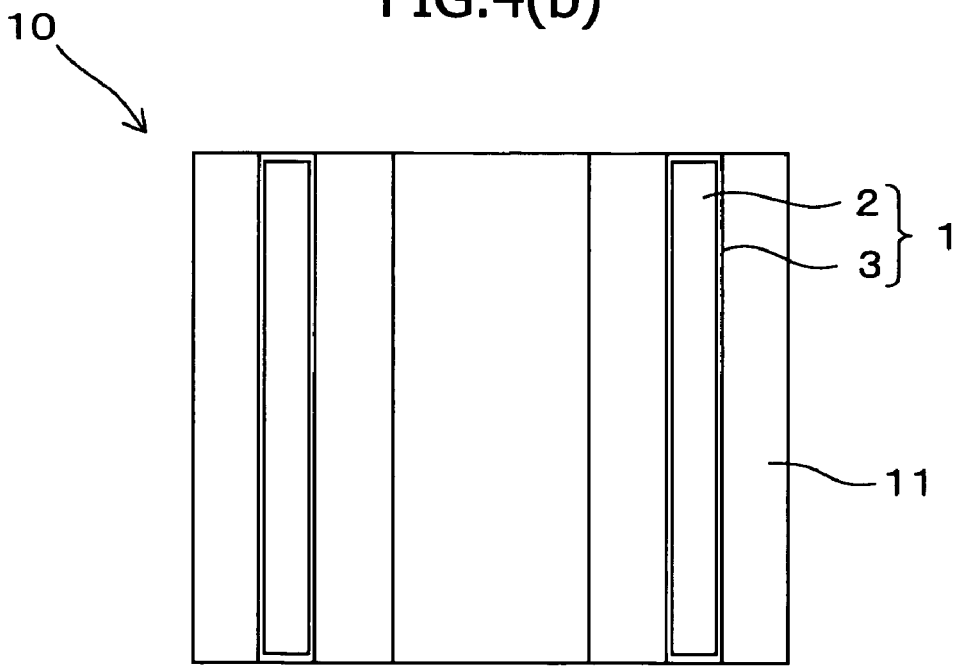

Thus, the sealed magnet according to the present invention can prevent hydrogen embrittlement, and can be effectively used in a wide range of fields such as magnetic circuits, motors and semiconductor manufacturing devices. Below, the sealed magnet according to the present invention utilized in a rotor of a four pole IPM (interior permanent magnet) motor is illustrated. FIG. 4 schematically shows a rotor of a four pole IPM motor, wherein the sealed magnet according to the present invention is utilized. Not exclusively, it is possible to provide a rotor 10 of the motor by providing rectangular holes in a rotor yoke 11 and inserting magnetized magnets into these holes, as illustrated in FIG. 4. More specifically, not exclusively, the ring-shaped rotor yoke 11 has a plurality of openings for inserting the sealed magnet 1 according to the present invention. The openings are disposed concentrically with the rotor yoke in regular intervals. The sealed magnets according to the present invention comprising the rare earth magnets 2 sealed in the aluminum cases 3 are inserted in the openings. Here, the magnetization direction of the each magnet is the radial direction, and is opposite of adjacent magnets. In FIG. 4, the magnetization direction of the magnets is indicated by arrows. Furthermore, the magnetization of the magnets may be carried out after the step of sealing by HIP processing and before assembling the rotor, or after assembling the rotor. That is to say, magnetized sealed magnets may be inserted in the rotor yoke, or if a dedicated magnetization jig is prepared, magnetization may be performed after inserting the magnets into the rotor yoke.

EXAMPLES

Working examples of the present invention are described below with reference to the attached drawings. The examples described below do not limit the present invention.

As the present working example, sealed magnets were manufactured as given below. That is to say, as schematically shown in FIG. 2, an aluminum case comprising a case portion and a lid portion was used. For the aluminum case, a material of aluminum alloy A6061 was used. For the rare earth magnets, a $Sm_2Co_{17}$ magnet was used as the $R_2Co_{17}$-based magnet, and an $Nd_2$—$Fe_{14}$—B magnet was used as the R—Fe—B-based magnet. For HIP processing, Ar gas was used as the pressure medium and processing was performed for 1 hour at a pressure of 1000 kg/cm$^2$ and a temperature of 500° C. 500° C. is the lower limit of the heat treatment temperature of the magnet, namely, it corresponds to the heat treatment temperature for generating the magnetic properties of the $ND_2$—$Fe_{14}$—B magnet, but since the processing time was about one hour, there were no changes in the magnetic properties. Below, the working example in which the $Sm_2Co_{17}$ magnet was used is taken as working example 1, and the working example in which the $Nd_2$—$Fe_{14}$—B magnet was used is taken as working example 2.

For comparison, $Sm_2Co_{17}$ magnets, wherein the magnet has had no surface treatment (comparative example 1), wherein the magnet is nickel plated with a film thickness of 20 μm (comparative example 2), and wherein the magnet is copper plated with a film thickness of 20 μm (comparative example 3) were used. In a similar manner, for comparison, $Nd_2$—$Fe_{14}$—B magnets, wherein the magnet has had no surface treatment (comparative example 4), wherein the magnet is nickel plated with a film thickness of 20 μm (comparative example 5), and wherein the magnet is copper plated with a film thickness of 20 μm (comparative example 6) were used.

For the hydrogen gas test, the sealed magnets according to the working examples, and the magnets according to the comparative examples were exposed at a pressure of 3 MPa for one day, or at a higher pressure of 15 MPa for one day or for seven days, subsequently observing the state of the magnets. The test temperature was 25° C., and the results are shown in Table 1.

TABLE 1

| Magnet | Working example/ Comparative example | Hydrogen gas test 3 MPa 1 day | 15 MPa 1 day | 15 Mpa 7 days |
|---|---|---|---|---|
| $Sm_2Co_{17}$ magnet | Comparative example 1 | NAD | destroyed | Destroyed |
| | Comparative example 2 | NAD | destroyed | Destroyed |
| | Comparative example 3 | NAD | NAD | Destroyed |
| | Working example 1 | NAD | NAD | NAD |
| Nd-Fe-B magnet | Comparative example 4 | destroyed | destroyed | Destroyed |
| | Comparative example 5 | NAD | destroyed | Destroyed |
| | Comparative example 6 | NAD | NAD | Destroyed |
| | Working example 2 | NAD | NAD | NAD |

NAD: nothing abnormal detected

As shown in Table 1, no abnormalities were observed in the sealed magnet according to the present invention, even after experiencing the severe conditions of 15 MPa for seven days. On the other hand, in the case of the Nd magnet on whose magnet surface no treatment was performed, the magnet was destroyed after just one day at 3 MPa (comparative example 4). In the case of the Sm magnet, hydrogen embrittlement was less than the Nd magnet, but it was destroyed at 15 MPa (comparative example 1). Hydrogen embrittlement is prevented by nickel plating and copper plating, but those magnets were destroyed when the treated time was increased (comparative example 2, 3, 5 and 6). It seems that hydrogen embrittlement proceeded because of pinholes in the plating film and hydrogen penetration. On the other hand, as noted above, HIP processing has the effect of squeezing out and removing air holes within the material, and thus there were no pinholes in the case of the present invention.

As given above, with the present invention, by covering the surface of a rare earth magnet with an aluminum case and sealing the permanent magnet by HIP processing, it is possible to increase the hydrogen gas resistivity of the rare earth magnet in a hydrogen gas atmosphere. Thus, it is possible to widen the range of environments in which the rare earth magnet can be used. Furthermore, in semiconductor manufacturing devices, by treating the surface of the rare earth magnet, there is no contamination of the reaction bath.

What is claimed is:

1. A sealed rare earth magnet comprising:

a rare earth magnet; and a case of aluminum or aluminum alloy having a lid portion sealed to a case portion, wherein the case covers entirety of the rare earth magnet and has substantially no pinholes such that penetration of hydrogen gas into an interior of the case is prevented, and wherein the magnet has a size and shape approximating the interior shape of the case.

2. The sealed rare earth magnet according to claim 1, wherein the case has a thickness of 0.5 to 10 mm.

3. The sealed rare earth magnet according to claim 1, wherein the lid portion is sealed to the case portion by HIP.

4. The sealed rare earth magnet according to claim 1, further comprising a seal between the case and lid portion that is characterized by the absence of welding.

5. The sealed rare earth magnet according to claim 1, wherein the rare earth magnet is a R--Co-based rare earth magnet and wherein R is selected from the group consisting of lanthanum (La), cerium (Ce), praseodymium (Pr), neodymium (Nd), europium (Eu), gadolinium (Gd), terbium (Tb), dysprosium (Dy), holmium (Ho), erbium (Er), thulium (Tm), ytterbium (Yb), lutetium (Lu), scandium (Sc) and yttrium (Y).

6. The sealed rare earth magnet according to claim 1, wherein the rare earth magnet is a R--Fe--B -based rare earth magnet in which R is a rare earth metal.

7. The sealed rare earth magnet according to claim 1, wherein the rare earth magnet is a R--Fe--B -based rare earth magnet and wherein R is selected from the group consisting of lanthanum (La), cerium (Ce), praseodymium (Pr), neodymium (Nd), europium (Eu), gadolinium (Gd), terbium (Tb), samarium (Sm), dysprosium (Dy), holmium (Ho), erbium (Er), thulium (Tm), ytterbium (Yb), lutetium (Lu), scandium (Sc) and yttrium (Y).

8. The sealed rare earth magnet according to claim 1, wherein the concentration of oxygen in the interior of the case is between 500 to 6,000 ppm.

9. The sealed rare earth magnet according to claim 1, wherein the concentration of hydrogen in the interior of the case less than 50 ppm.

10. The sealed rare earth magnet according to claim 1, wherein the concentration of hydrogen in the interior of the case less than 10 ppm.

* * * * *